US005375960A

United States Patent [19]

Schiller

[11] Patent Number: 5,375,960

[45] Date of Patent: Dec. 27, 1994

[54] GARBAGE COLLECTION AND TRANSPORT SYSTEM

[75] Inventor: Rolf Schiller, Ravensburg, Germany

[73] Assignee: VC-Recycling-Patentwerwertung GmbH, Ravensburg, Germany

[21] Appl. No.: 962,208

[22] PCT Filed: Jun. 27, 1991

[86] PCT No.: PCT/DE91/00528

§ 371 Date: Dec. 29, 1992

§ 102(e) Date: Dec. 29, 1992

[87] PCT Pub. No.: WO92/00232

PCT Pub. Date: Jan. 9, 1992

[30] Foreign Application Priority Data

Jun. 29, 1990 [DE] Germany ..... 4020777
Aug. 6, 1990 [DE] Germany ..... 4024879

[51] Int. Cl.[5] ..... B65F 3/02

[52] U.S. Cl. ..... 414/406; 414/539

[58] Field of Search ..... 414/406, 407, 408, 409, 414/410, 539, 546, 487; 220/564, 909

[56] References Cited

U.S. PATENT DOCUMENTS

| | | | |
|---|---|---|---|
| 2,914,205 | 11/1959 | Trubinski | 414/525.4 X |
| 2,961,977 | 11/1960 | Coleman | 414/540 X |
| 3,211,312 | 10/1965 | Miller | 414/406 |
| 3,680,478 | 8/1972 | Beachner, Jr. et al. | 414/410 X |
| 4,113,125 | 9/1978 | Schiller | 414/406 |
| 4,960,220 | 10/1990 | Foa | 414/406 X |
| 5,035,563 | 7/1991 | Mezey | 414/409 |
| 5,035,564 | 7/1991 | Matsumoto | 414/409 |
| 5,074,737 | 12/1991 | Pellegrini et al. | 414/406 |
| 5,094,582 | 3/1992 | Molzhon | 414/406 |

FOREIGN PATENT DOCUMENTS

| | | | |
|---|---|---|---|
| 0220483A2 | 5/1987 | European Pat. Off. . | |
| 0257442 | 3/1988 | European Pat. Off. | 414/408 |
| 0257442A2 | 3/1988 | European Pat. Off. . | |
| 0314238A1 | 5/1989 | European Pat. Off. . | |
| 0354256 | 2/1990 | European Pat. Off. | 414/408 |
| 0356833A1 | 3/1990 | European Pat. Off. . | |
| 1231616 | 12/1966 | Germany | 414/406 |
| 2558433C3 | 3/1978 | Germany . | |
| 2902163A1 | 7/1980 | Germany . | |
| 8333556.0 | 2/1985 | Germany . | |
| 3537546 | 4/1987 | Germany | 414/409 |
| 3537546C2 | 4/1987 | Germany . | |
| 8706418.9 | 8/1987 | Germany . | |
| 3640132 | 10/1987 | Germany | 414/409 |
| 3703557A1 | 8/1988 | Germany . | |
| 8810587.3 | 12/1988 | Germany . | |
| 3829076C1 | 12/1989 | Germany . | |

OTHER PUBLICATIONS

R. Schiller, "Das Mehrkammer-Muellsystem", *16 VDI Nachrichten,* No. 45, Nov. 12th, 1976.

*Primary Examiner*—David A. Bucci
*Assistant Examiner*—James Keenan
*Attorney, Agent, or Firm*—Spencer, Frank & Schneider

[57] ABSTRACT

A garbage collection and transport system includes a garbage vehicle (1) with a partition (2) which separates the interior of the vehicle (1) into different stowage compartments (3, 4) for the separate collection of garbage of different types (A, B). The vehicle (1) has charging openings (6, 7) which are decoupled from the arrangement of the partition (2) between the individual stowage compartments (3, 4). To this end, the charging openings (6, 7) on the vehicle are arranged with individual filling openings (15, 16) in such a way that they lie fully in the region of a given stowage compartment and the filling opening that is not allocated to this stowage compartment is connected to the stowage compartment allocated to this fraction of the garbage via intermediate transport channels or supply devices.

21 Claims, 8 Drawing Sheets

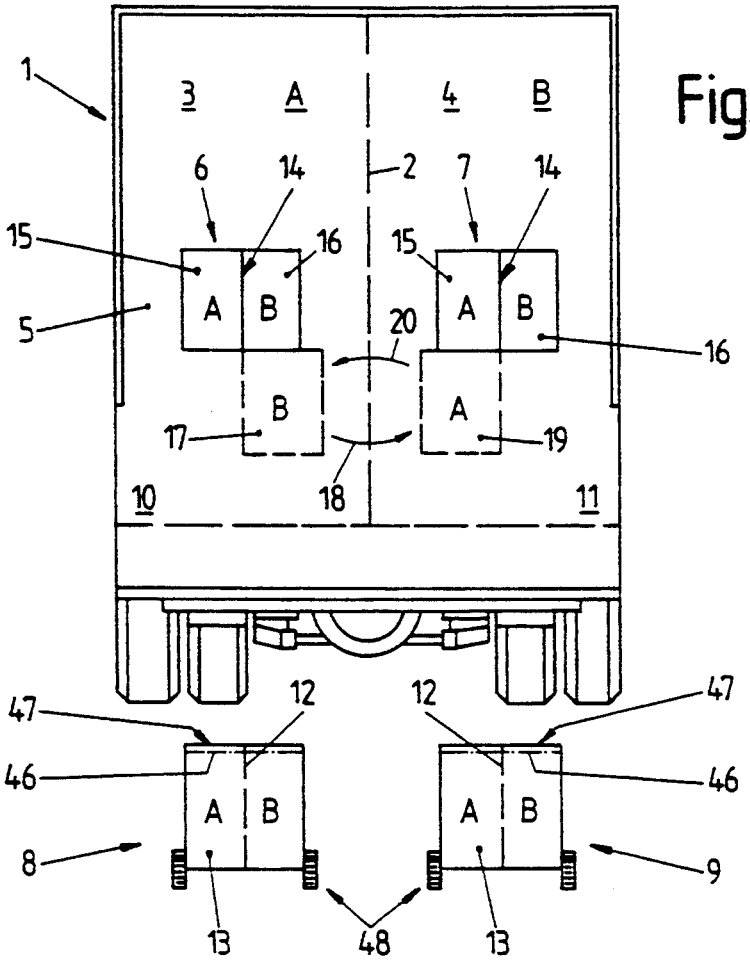
Fig. 1
Fig. 1a
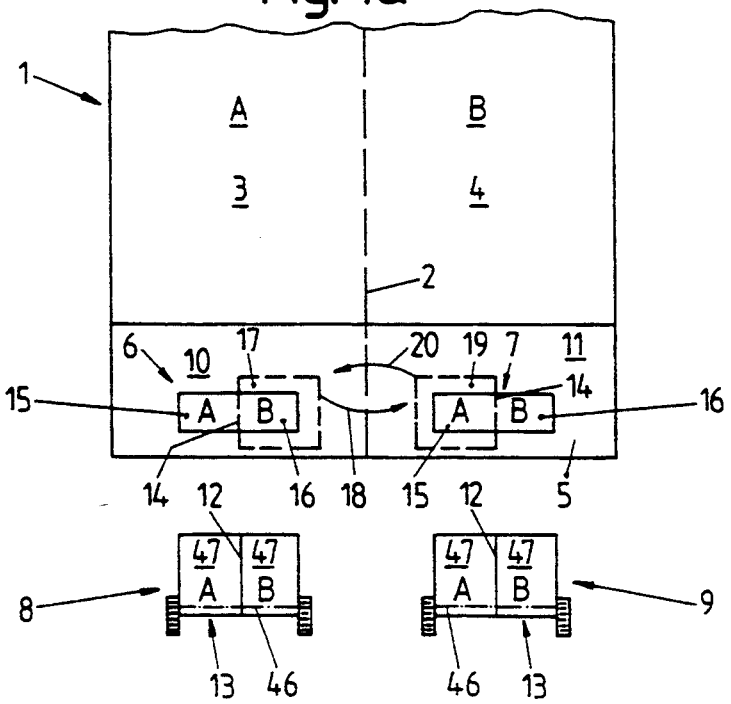

Fig. 3
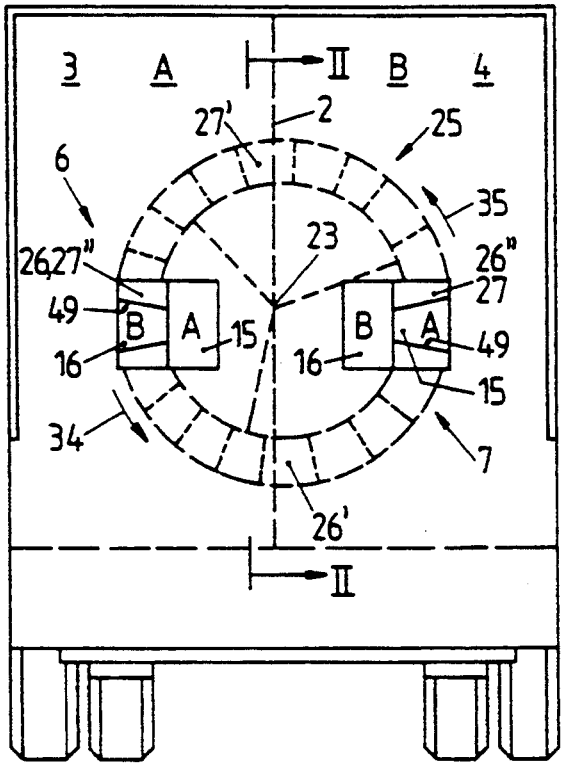
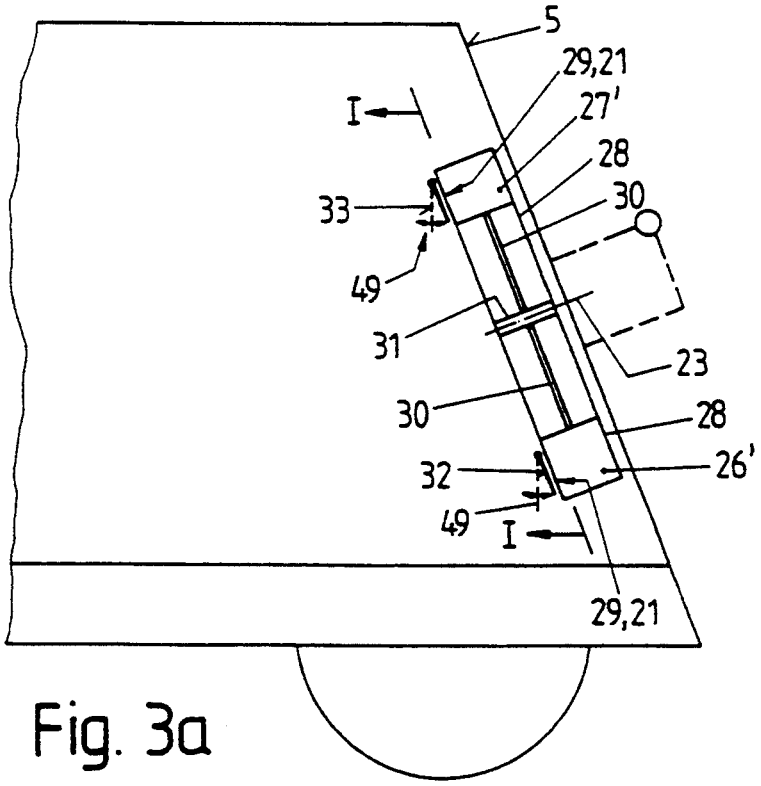
Fig. 3a

Fig. 5
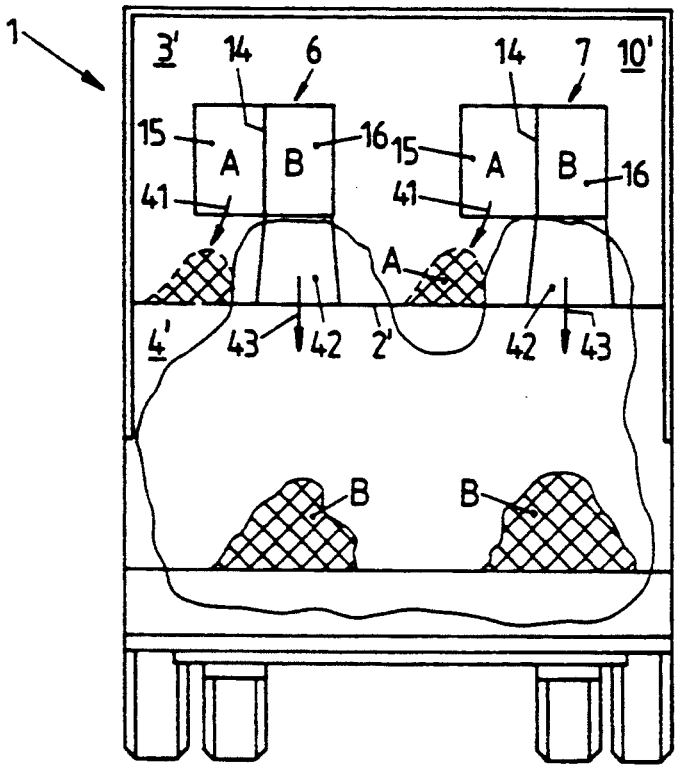
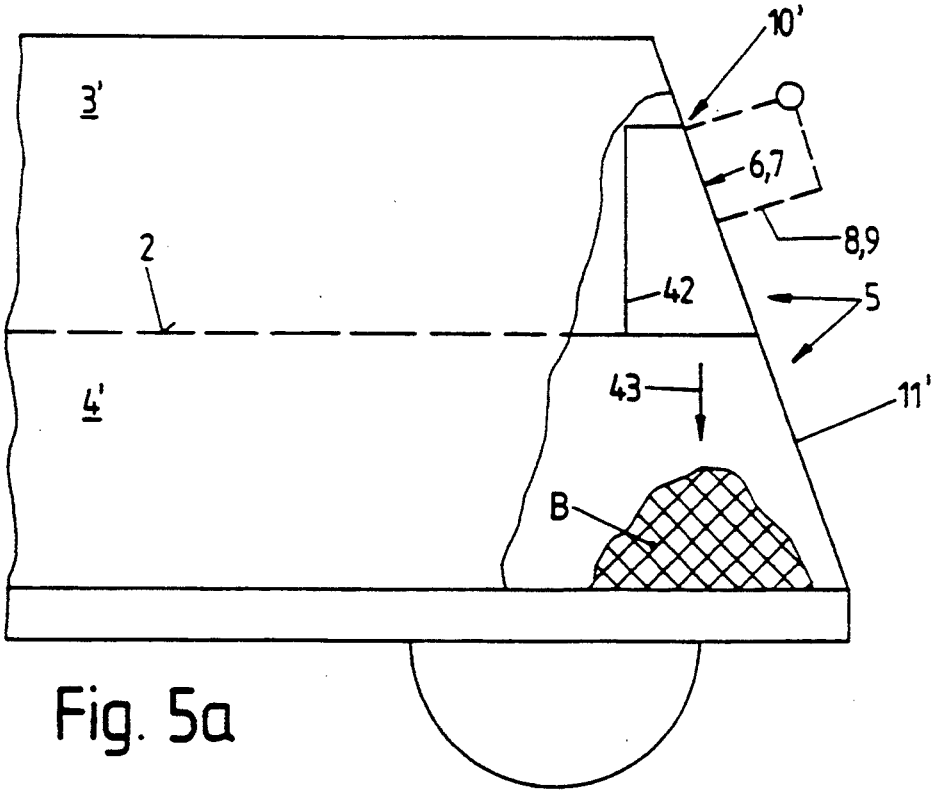
Fig. 5a

GARBAGE COLLECTION AND TRANSPORT SYSTEM

BACKGROUND OF THE INVENTION

The invention relates to a garbage collection and transport system, and more particularly to a garbage collection and transport system which utilizes garbage vehicles and preferably domestic garbage cans for separate reception of refuse of different composition in at least two chambers in the garbage can, and a corresponding number of stowage compartments or chambers in the garbage vehicle, at least one charging opening on the garbage vehicle having in each case at least one partition forming, for the garbage fractions, filling openings, the positioning of which coincides or is brought into coincidence with the partition on the garbage can.

From German Patent Specification 25 58 433 or EP 0 220 483 A2 a garbage collection and transport system is known in which both the collecting can or garbage can and the garbage vehicle itself are divided by at least one partition into a plurality of chambers which receive different fractions of the garbage. In this arrangement, when the garbage can is emptied its contents are discharged through a charging opening on the garbage vehicle in such a manner that the respective chambers in the garbage can and in the garbage vehicle cooperate with one another, that is to say the various garbage fractions still remain separated from one another in the garbage vehicle. This system is described in the form of a so-called multi-chamber garbage system in numerous publications (for example VDI-Nachrichten No. 45, Nov. 12, 1976, page 16).

From EP 0 220 483 a garbage vehicle is known which has a transverse wall disposed parallel to the rear wall of the garbage vehicle and approximately in the middle of the latter. If this garbage vehicle is loaded through the rear wall, the chambers in the garbage vehicle are disposed one behind the other and not side by side, so that a conveyor device is necessary to carry the garbage intended for the front chamber of the garbage vehicle from the charging opening in the rear wall to said chamber. A transport device of this kind may, for example, be a conveyor belt. Since this additional conveyor device must pass through the rear chamber of the garbage vehicle, it is usually disposed at the side or top on the garbage vehicle in order to take up as little space as possible in the rear chamber of the garbage vehicle and to avoid causing an obstruction. This, however, entails the disadvantage that a greater loading height is required for emptying the garbage cans or, with a low loading height, losing some of the loading volume of the vehicle. Moreover, the loading paths are very wide and therefore dangerous, cost-intensive and very expensive to construct.

In the previously mentioned EP 0 220 483 provision is also made for a garbage can having at least two chambers to be emptied into an additional intermediate can, which in turn, with the aid of a lifting and tipping device, empties the contents of at least one chamber of the garbage can through the charging opening into the front stowage chamber of the vehicle by means of a conveyor belt. The other chamber of the garbage can is emptied directly into the rear region of the garbage vehicle, that is to say into the rear chamber. This intermediate can is in general used for collection purposes.

SUMMARY OF THE INVENTION

The object of the invention is therefore that of eliminating the abovementioned disadvantages and in particular providing a multi-chamber garbage vehicle in which the garbage fractions can be transferred from the can into the vehicle at an optimum position on the vehicle (stowage space), preferably at the rear end, and in which the least possible stowage space is required for delivering the fractions into the respective appropriate stowage spaces in the vehicle.

The garbage collection and transport system according to the invention is characterized in that at least one partition in the garbage vehicle is in the form of a vertical partition or horizontal partition which divides the loading wall of the garbage vehicle, particularly its rear wall, into at least two loading zones disposed side by side or one above the other, in that at least one charging opening is disposed with its filling openings to a very great extent on a loading zone and in that at least one of the filling openings has associated with it an intermediate receiving device or feeding device for a garbage fraction A, B, which device transports at least one fraction A, B from the garbage can to the other stowage compartment of the garbage vehicle for emptying purposes. Such a garbage collection and transportation system has the advantage over known systems that the garbage is introduced as far as possible parallel to the filling plane and not through the vehicle. It is an additional advantage that fundamental disconnection of the arrangement of the charging opening on the garbage vehicle from the arrangement of the partition forming the stowage compartments in the garbage vehicle is achieved. This applies in particular to a chamber arrangement in the garbage vehicle in which the stowage compartments, viewed from the charging opening, are disposed side by side and not one behind the other. In an arrangement of this kind the charging opening was always so disposed in the prior art as to cover the two stowage compartments, that is to say the appertaining partitions of the garbage can, the charging opening and the vehicle are in alignment with one another.

The basic principle underlying the invention is that the charging opening or a plurality of charging openings are situated completely independently of the arrangement on the vehicle wall, particularly the rear wall, of the partition forming the vehicle stowage compartments.

Two charging openings lying opposite one another can for example be disposed on the vehicle on the right and the left of a vertical longitudinal partition through the vehicle. The contents of at least one chamber of the garbage can must then be transported to the other side of the vehicle partition.

The partition may also be in the form of a horizontal longitudinal partition, in which case for example two charging openings may once again be disposed in the vehicle above or below this partition. One or more charging openings for domestic garbage cans or a large charging opening for large garbage cans may accordingly be provided on the vehicle, while each charging opening may be situated in front of any stowage space in the vehicle. The garbage fraction not belonging to this stowage compartment is then transported to the respective adjoining side of the garbage vehicle, that is to say to the stowage space appertaining to this garbage fraction, by means of an intermediate receiving device or feeding device, which may be in the form of an intermediate can, a connecting shaft, or the like.

Depending on the arrangement of the charging openings on the vehicle, in respect of their position relative to the partition in the garbage vehicle, various arrangements are possible for the intermediate receiving device or the device for transporting the respective garbage fraction to the other stowage compartment in the garbage vehicle. To sum up, this may be an intermediate container, a conveyor device, such as a wheel elevator, a conveyor belt, a bucket conveyor, or a scraper floor, or else a simple chute or drop shaft.

It is therefore particularly advantageous for one of the chambers of the garbage can to be emptied directly into the appertaining garbage-vehicle stowage compartment lying behind the loading zone provided with the charging opening. The garbage fraction which in the garbage can appertains to the other stowage compartment of the garbage vehicle is then transported thereto with the aid of the most diverse transport devices, which will be described more fully below, depending on the position of the charging opening.

Further details of the invention are illustrated in the drawings and explained in greater detail in the following description.

BRIEF DESCRIPTION OF THE DRAWINGS

FIG. 1 is an elevation of the rear of a garbage vehicle having a vertical partition between the stowage compartments and two charging openings, with appertaining garbage cans, FIG. 1*a* is a plan view of the arrangement shown in FIG. 1, FIG. 3 is a rear elevation of the garbage vehicle having a vertical partition between the stowage compartments and an intermediate can in the form of a wheel elevator or the like, FIG. 3*a* is a section on the line II—II in FIG. 3, FIG. 5 is a rear elevation of a vehicle having a horizontal partition between the stowage compartments, and FIG. 5*a* is a side view of the vehicle shown in FIG. 5.

DESCRIPTION OF THE PREFERRED EMBODIMENTS

Figure 2:
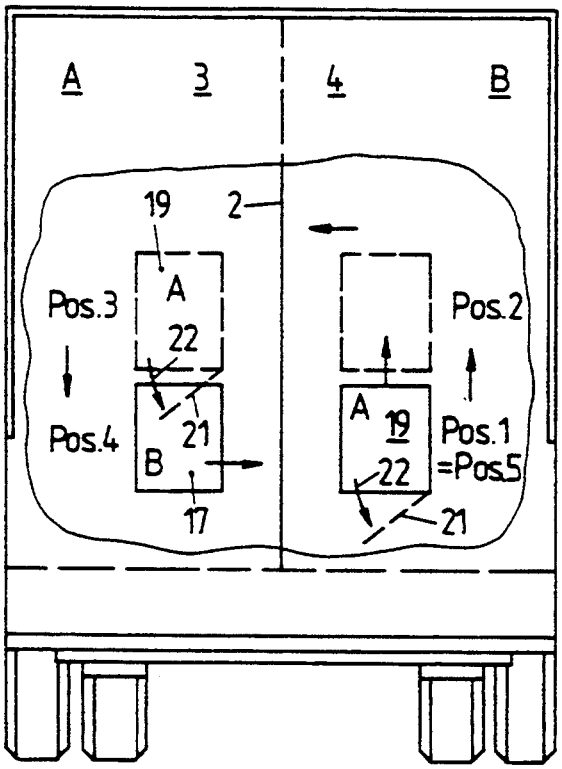
FIG. 2 is a rear elevation of a garbage vehicle having a vertical partition between the stowage compartments, with the wall broken away to show various positions of the intermediate cans.

FIG. 1 is a rear elevation of a garbage vehicle or truck 1 which has a vertical garbage truck partition 2 lying in the longitudinal center plane of the vehicle so as to form two stowage compartments or chambers 3, 4 disposed side by side in the garbage vehicle 1. In FIG. 1*a* a plan view corresponding to FIG. 1 is shown. The chambers or stowage compartments 3, 4 can also be formed by two containers.

The rear wall 5 of the garbage vehicle serves as a loading wall 5 that is preferably inclined. Charging openings 6, 7 are provided on it for the garbage cans 8, 9. The loading wall 5 is divided by the partition 2 into two portions or loading zones 10, 11, behind which the respective stowage compartments 3 and 4 are situated in the garbage vehicle 1. The garbage cans 8, 9 likewise each have a garbage can partition 12, which for practical reasons is in each case at right angles to the rear wall 13 of the garbage can. The rear wall 13 contains the lid fastening, which is provided with a pivot pin 46 for the lid 47. The reference numbers 48 designate the wheels of the garbage can 8, 9.

The garbage can 8, 9 is divided by the partition 12 into the chambers A, B, the chamber A containing a first garbage type or fraction A and the chamber B a second garbage fraction B. The garbage type or fraction A is to be introduced into the stowage compartment 3 and the garbage fraction B into the stowage compartment 4 in the garbage vehicle 1. The corresponding designations A, B are therefore also shown on the garbage vehicle in FIGS. 1 and 1*a*. As a rule, this is achieved in the prior art by so disposing charging openings 6, 7 that the partition 12 of the garbage can 8, 9 is in alignment with the charging opening partition 14 of the charging opening 6, 7 and that the latter is in alignment with the partition 2 of the garbage vehicle. The respective chambers or stowage compartments for the garbage fractions A, B then lie directly one behind the other.

According to the invention, one or more charging openings 6, 7 should now no longer be disposed in alignment with the partition 2 of the vehicle, but should be disposed eccentrically relative thereto. In the embodiment according to FIGS. 1 and 1*a* the charging opening 6 lies with its two portions or filling openings 15, 16 entirely in the loading zone 10 of the rear wall 5, behind which only the stowage compartment 3 for the garbage fraction A is situated, while the charging opening 7 with the two portions or filling openings 15, 16 is disposed entirely on the loading zone 11, behind which only the stowage compartment 4 for the fraction B is situated. The fraction A of the garbage can 8 can accordingly be introduced directly into the stowage compartment 3 through the filling opening 15 of the charging opening 6, while the fraction B cannot be introduced directly into the stowage compartment 4 for the fraction B by way of the filling opening 16 of the charging opening 6. The filling opening 16 of the charging opening 6 must therefore be provided with an intermediate container 17, which first receives the fraction B from the garbage can 8 by way of the filling opening 16 and then conveys it into the neighbouring stowage compartment 4. This is indicated by the arrow 18.

Similarly, the charging opening 7, disposed on the loading zone 11, with the two filling openings 15, 16 must be so constructed that the fraction B from the garbage can 9 passes directly into the stowage compartment 4 provided in the garbage vehicle 1 for the fraction B, while the fraction A from the garbage can 9 first passes by way of the filling opening 15 of the charging opening 7 into the intermediate container 19, which must then be emptied into the stowage compartment 3. This transfer is indicated by the arrow 20 in FIG. 1.

The rear wall 5 of the garbage vehicle 1 is disposed slightly obliquely, so that in FIG. 1*a* the loading zones 10, 11 of the rear wall 5 can be seen. In FIG. 1 the garbage cans 8, 9 are shown in rear view (view of the rear wall 13), and in FIG. 1*a* in plan view (view of the lid 47).

Figure 2A:
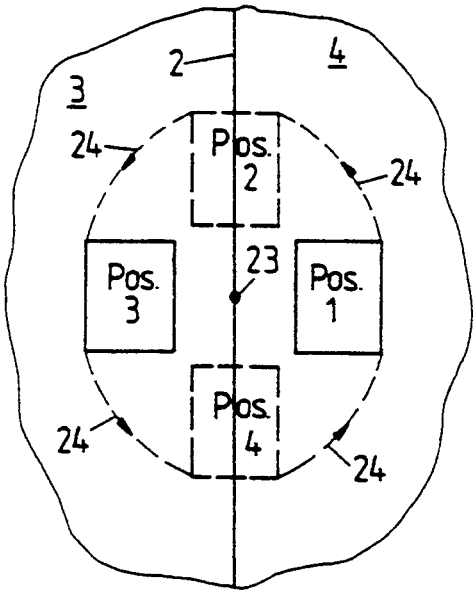
FIG. 2*a* illustrates the change of position of the intermediate cans by means of a rotary movement.

The possible movements of the two intermediate containers 17, 19 in FIGS. 1 and 1*a* are illustrated schematically in FIGS. 2 and 2*a* respectively. The movement of the intermediate containers 17, 19 may be translatory or rotary, FIG. 2 showing a translatory movement and FIG. 2*a* a rotary movement. In order for example to empty the intermediate container 19 shown in FIG. 1, it is first brought by an upward movement into the position 2, shown thereabove, and is displaced from there by a transverse horizontal movement into the position 3, as shown in FIG. 2. The contents of the chamber comprising the garbage fraction A of the intermediate container 19 have thus passed from the stowage compartment 4 into the stowage compartment 3, intended for the garbage fraction A, in the garbage vehicle. By way of an openable flap 21 the garbage fraction A in the position 3 in FIG. 2 can then be emptied into the stowage compartment 3. After being emptied, the intermediate container 19 can be moved downwards to the position 4, where it serves as intermediate container 17 for the fraction B from the filling opening 16 of the charging opening 6. In the rotary movement from position 1 to position 4, the intermediate container 17 containing the fraction B then passes in a transverse movement into the position 1 or position 5, so that the fraction B can be emptied into the stowage compartment 4 by way of the flap 21. The emptying of the fractions A and B is indicated in each case by the arrow 22.

Figure 3B:
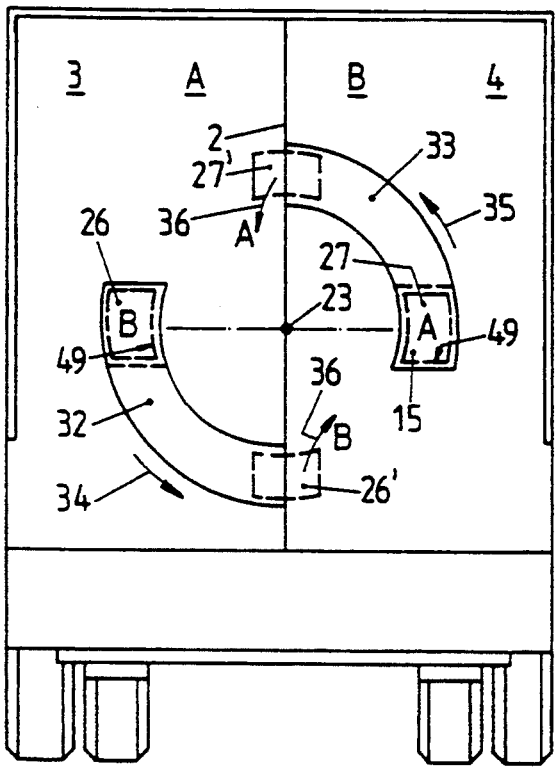
FIG. 3*b* is a section on the line I—I in FIG. 3*a*, FIGS. 4 and 4*a* show, in rear elevation, a vehicle having a vertical partition for the stowage compartments, with a further development of the arrangement of the charging openings directly on the partition.

The translatory movement of the intermediate containers which is illustrated in FIG. 2 is shown in FIG. 2*a* as a rotary movement about the center 23. The positions 1 and 3 in FIG. 2*a* represent the positions of the intermediate containers 17, 19 shown in FIG. 1. Transfer to the respective other stowage compartment in the vehicle is achieved by means of the rotary movement indicated in FIG. 2*a*, as shown by the arrows Another variant of the movement of the intermediate containers 17, 19 is illustrated in FIGS. 3, 3*a* and 3*b*. The corresponding sections on the lines I—I and II—II are indicated in the foregoing section entitled "Brief Description of the Drawings."

The stowage compartment 3 contains once again the fraction A, and the stowage compartment 4 the fraction B, of the garbage. In contrast to the arrangement shown in FIGS. 1 and 1*a*, the filling opening 15 on the right in each case is intended for the garbage fraction A and the filling opening 16 on the left for the garbage fraction B. However, this is in principle the same. The transport device provided for moving the respective garbage fraction A, B from the two charging openings 6, 7 consists in FIGS. 3, 3*a*, 3*b* of a rotating bucket conveyor 25 which likewise turns about the center 23 lying in the longitudinal plane of symmetry or on the partition 2. The bucket conveyor 25 consists of a multiplicity of cuboid containers, for example 26, 27, which in FIG. 3*a* are shown in the bottom position (26') and top position (27'). The containers 26, 27 are open on their side 28 facing the rear wall 5, so that they can be filled in each case with the fraction A or B by way of the filling openings 15, 16. The side 29 of the containers 26, 27 which is remote from the rear wall 5 may be in the form of an opening flap 21, analogously to that shown in FIG. 2. The opening flap 21 is then in each case opened after the rotary movement into the neighbouring stowage compartment has been made. For this purpose, the containers 26, 27 are fastened on arms 30 fastened on a slewing ring 31 having a center axis 23.

As illustrated in FIGS. 3*a* and 3*b*, instead of an openable container bottom 29, 21, two immovably mounted guide plates 32, 33 may be provided which approximately describe a circular arc of 90°. The side 29 of the container 26 open to the stowage compartment 3 is closed by the guide plate 32 until the container has travelled along the path indicated by the arrow 34 to the bottom position 26'. After passing beyond the partition 2 in the garbage vehicle, the side 29 can then open and empty the fraction B into the chamber 4. Similarly, the side 29 of the container 27 remains closed by the guide plate 33 during the rotary movement in the direction of the arrow 35 until the container 27 containing the fraction A has moved from the stowage compartment 4 into the stowage compartment 3 (container 27'). The emptying of the respective fractions A and B is indicated by the arrows 36. The guide plates 32 and 33 are therefore in the form of stationary circular segments which close the respective containers 26 and 27 containing respectively the fraction A or B not intended for the stowage compartment 3 or 4 respectively until the container 26, 27 is situated in the correct stowage compartment.

Figure 4:
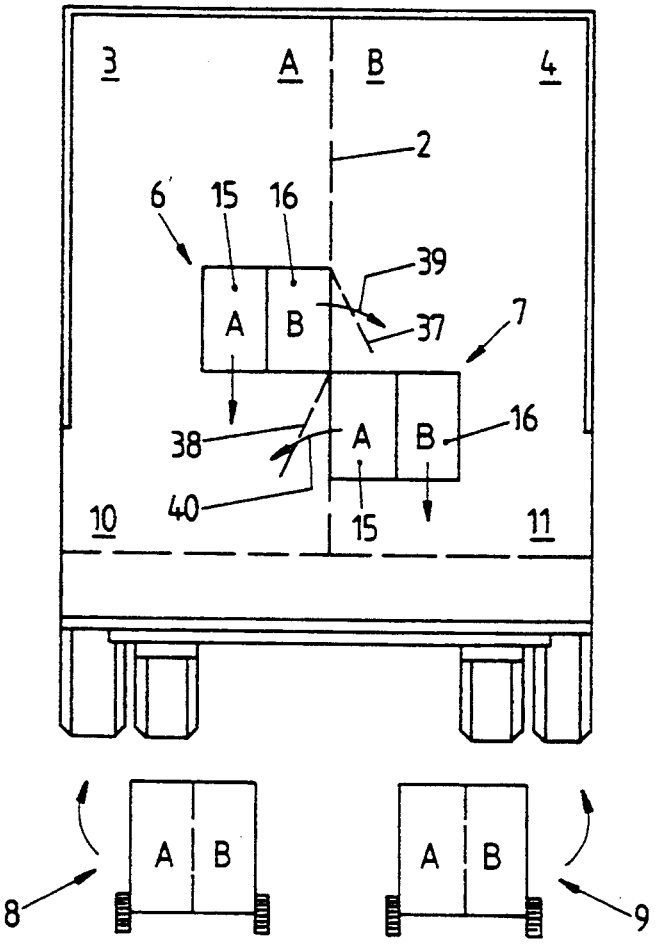
Figure 4A:
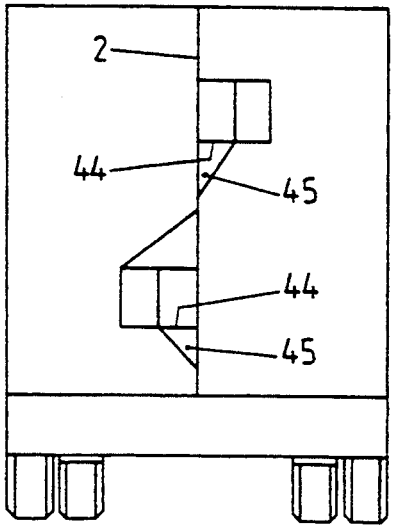

In the variant example of embodiment illustrated in FIG. 4, the charging openings 6, 7 shown in FIG. 1 are so disposed in the two loading zones 10, 11 that an outer side wall 37, 38 is situated directly in the plane of the partition 2. The charging opening 6, which is disposed in the loading zone 10 with the stowage compartment 3 for the fraction A lying behind it, accordingly contains a filling opening 16, which is connected to the stowage compartment 4 via an outer wall 37 disposed on the right in FIG. 4. The fraction B in the charging opening 6 can accordingly be emptied via this outer wall 37 directly into the stowage compartment 4 for the fraction B. This is illustrated by the arrow 39. Similarly, the charging opening 7 in the loading zone 11 has a filling opening 15 for the fraction A, which has an outer side wall 38 disposed on the left in FIG. 4 and opens into the stowage compartment 3 for the fraction A. The transfer of the fraction A from the charging opening 7 to the stowage compartment 3 is indicated by the arrow 40. These openable outer walls 37, 38 thus provide direct access from the charging openings 6, 7 to the respective neighbouring stowage compartment 3, 4. Instead of the outer walls 37, 38 it is also possible to provide downwardly directed openings 44 provided with chutes 45 leading into the respective neighbouring stowage compartment. This is shown in FIG. 4*a*.

FIGS. 5 and 5*a* show another example of an embodiment of the invention comprising a garbage vehicle 1 having a horizontal partition 2' dividing the garbage vehicle into an upper stowage compartment 3' receiving the garbage fraction A and a lower stowage compartment 4' receiving the garbage fraction B. The horizontal partition 2' extends over the entire length of the garbage vehicle. In contrast to the embodiments illustrated in the previous figures, in the embodiment according to FIGS. 5 and 5*a*, the two charging openings 6, 7 provided with the vertical partition 14 are disposed in the upper loading zone 10', that is to say the bottom region 11' of the rear wall 5 contains no charging opening for the garbage cans. The charging openings 6, 7 contain in turn filling openings 15, 16 provided with a partition 14, a vertical partition in the example of this embodiment, disposed between them, to receive the garbage fractions A, B from the garbage cans 8, 9 (see FIG. 1). In this arrangement, the filling openings 15 of the two charging openings 6, 7 are each connected directly to the upper storage compartment 3', that is to say the fraction A can be discharged directly into the stowage compartment 3' (arrow 41). The garbage fraction B is delivered via the filling opening 16 of the two charging openings 6, 7 via respective chutes 42 into the stowage compartment 4' situated therebelow (arrow 43). Despite the provision of two charging openings in the region of the loading-zone 10' of a determined stowage compartment (here the stowage compartment 3'), the fractions A and B can thus be correctly delivered to the respective stowage compartment 3' or 4'. The two charging openings 6, 7 can of course also be provided with filling openings 15, 16 lying one above the other and having corresponding chamber feed means.

In FIG. 5*a*, a side view of the arrangement according to FIG. 5 is shown. Like parts are given like reference numerals.

Figure 5B:
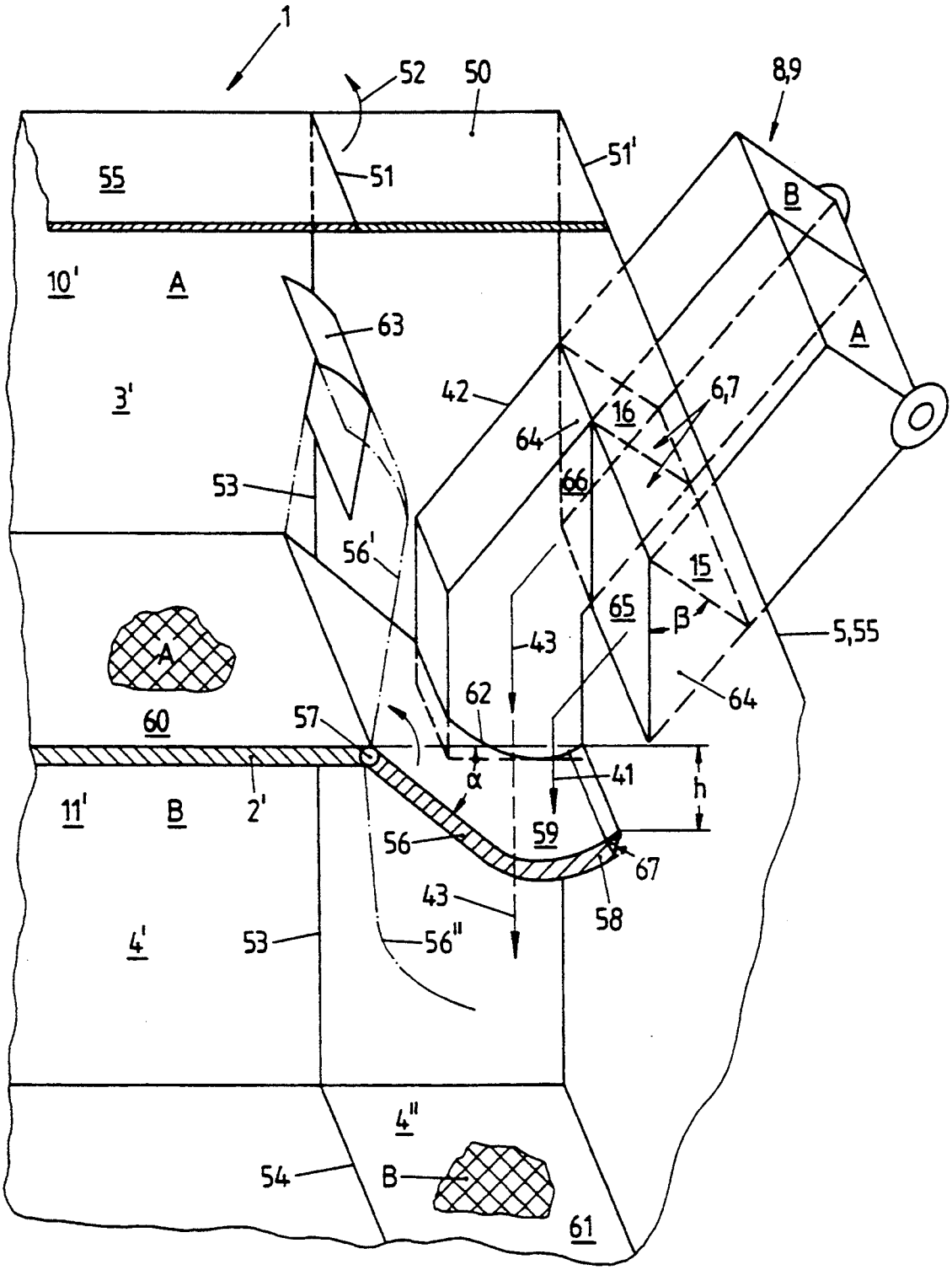
FIG. 5*b* is a three-dimensional inside view of the vehicle shown in FIGS. 5 and 5*a*, with a modified charging opening and an added stowing flap.

FIG. 5*b* shows a three-dimensional inside view of the rear part of a vehicle, in a forwardly sloping view, constituting a further development or modification of the vehicle shown in FIGS. 5 and 5*a*. For the purpose of simplification, only one charging opening 6, 7 provided with the filling openings 15, 16 is shown. The same reference numerals as in the previous figures are, moreover, used for the same parts. Reference is made to the corresponding description.

In compression garbage vehicles, that is to say garbage vehicles in which the garbage is compressed, the rear region 50 of the garbage vehicle 1 can be swiveled upwards (arrow 52) about a horizontal axis 51 for the purpose of emptying the stowage compartments 3', 4'. The appertaining dividing line in the side wall is designated 53 and that in the bottom is given the reference 54. The horizontal axis extends along the vehicle roof 55, which in FIG. 5*b* is shown cut open. The horizontal turning or swiveling axis 51 may, however, also be situated on the top edge of the rear wall 5 (axis 51'), so that the rear wall 5 can be swiveled upwards solely for emptying purposes.

In a vehicle of this kind the rear part of the horizontal partition 2' is in the form of a stowing flap or loading tray 56, as shown in longitudinal section in FIG. 5*b*. The stowing flap 56 has a horizontally extending swiveling axis 57 or swivel hinge 57, which makes it possible to swivel the stowing flap into an upper position 56' (shown in-broken lines) or else into a lower position 56'', which is likewise shown. This last-mentioned feature is expedient, for example, for emptying the upper stowage compartment 3' while at the same time the lower stowage compartment 4' is closed. When the loading tray 56 is lowered, the upwardly directed swiveling movement necessitates a free space behind it, and this space can, for example, be bridged over by a flexible rubber lip 67 or the like.

The stowing flap or loading tray 56 is downwardly inclined by an angle $\alpha \approx 10°-50°$ relative to the partition 2', the end region 58 of the loading tray 56 swiveling in an arc into the horizontal plane. The surface 59 onto which the fraction A falls from the stowage compartment A of the garbage can 8, 9 is thus situated at a height h below the support surface 60 on the partition 2'. The charging opening 15, 16 on the garbage vehicle 1 can be shifted downwards in height at least by this amount. Consequently, if it is desired to shift the charging openings 6, 7 further downwards on the rear wall 5 of the vehicle 1, this can be done by downwardly directed offsetting of the rear part of the partition 2'. For this purpose, the horizontal partition 2' of the vehicle 1 may also be made rigid in the rear region, that is to say without the swivel hinge 57. A rigid loading tray 56 formed in this manner can then, together with the receiving space 4'' situated beneath it (see FIG. 5*b*), be emptied by means of the usual emptying devices (not shown here), so that the garbage passes into the actual stowage compartments 3', 4'.

The arrangement illustrated in FIG. 5*b* with a swivelable loading tray 56 for charging the upper stowage compartment 3' with the fraction A constitutes a particularly weight-saving arrangement for disposing of the garbage. This construction dispenses with a separate emptying device and at the same time serves to keep the upper stowage compartment 3' closed during the emptying of the lower stowage compartment 4', so that effectively separate discharge of the respective garbage fractions A and B from the stowage compartments 3' and 4' is possible. When the loading tray 56 is swiveled up into the position 56', it serves as a flap for loading the fraction A into the upper stowage compartment 3' and can at the same time be used to compact the garbage in said stowage compartment.

As already shown in FIGS. 5 and 5*a*, the vehicle according to the arrangement shown in FIG. 5*b* also has a chute or ejection chute 42 connecting the filling opening 16 of the charging opening 6, 7 to the lower stowage compartment 4' for the purpose of feeding to the latter the garbage fraction B from the garbage can 8 or 9. The ejection operation is illustrated by an arrow 43. In the region of this ejection chute 42 the swivelable or rigid loading tray 56 has a correspondingly shaped aperture 62, so that the garbage fraction B can fall through downwards into the stowage compartment 4'. When the loading tray 56 is swiveled up into the position 56', a correspondingly shaped cover plate 63 fastened to the side wall of the vehicle closes the aperture 62 in that position. If the cover plate 63 were not provided, garbage could otherwise fall through to the rear from the stowage compartment 3'.

In the embodiment shown in FIG. 5*b* the rear wall 5 is in the form of a vertical, or almost vertical, wall. In contrast thereto, the two filling openings 15, 16 of the charging opening 6, 7 are rearwardly inclined by the angle $\beta \approx 45°$ relative to the rear wall 5, so that they project obliquely towards the rear and enable the garbage cans 8, 9 to be correspondingly received obliquely. The filling openings 15, 16 are then connected via the wall portions 64 to the through openings 65, 66 in the rear wall 5. The inclined filling openings 15, 16 therefore lie behind the actual vertical rear wall 5.

Corresponding to the swivelable mounting of the stowing flap or loading tray 56 for closing the upper stowage compartment 3' or the lower stowage compartment 4', the lower loading region 61 may also, if desired, be swivelable, in which case the same shaft can be used for the top mounting of an emptying device.

Figure 5C:
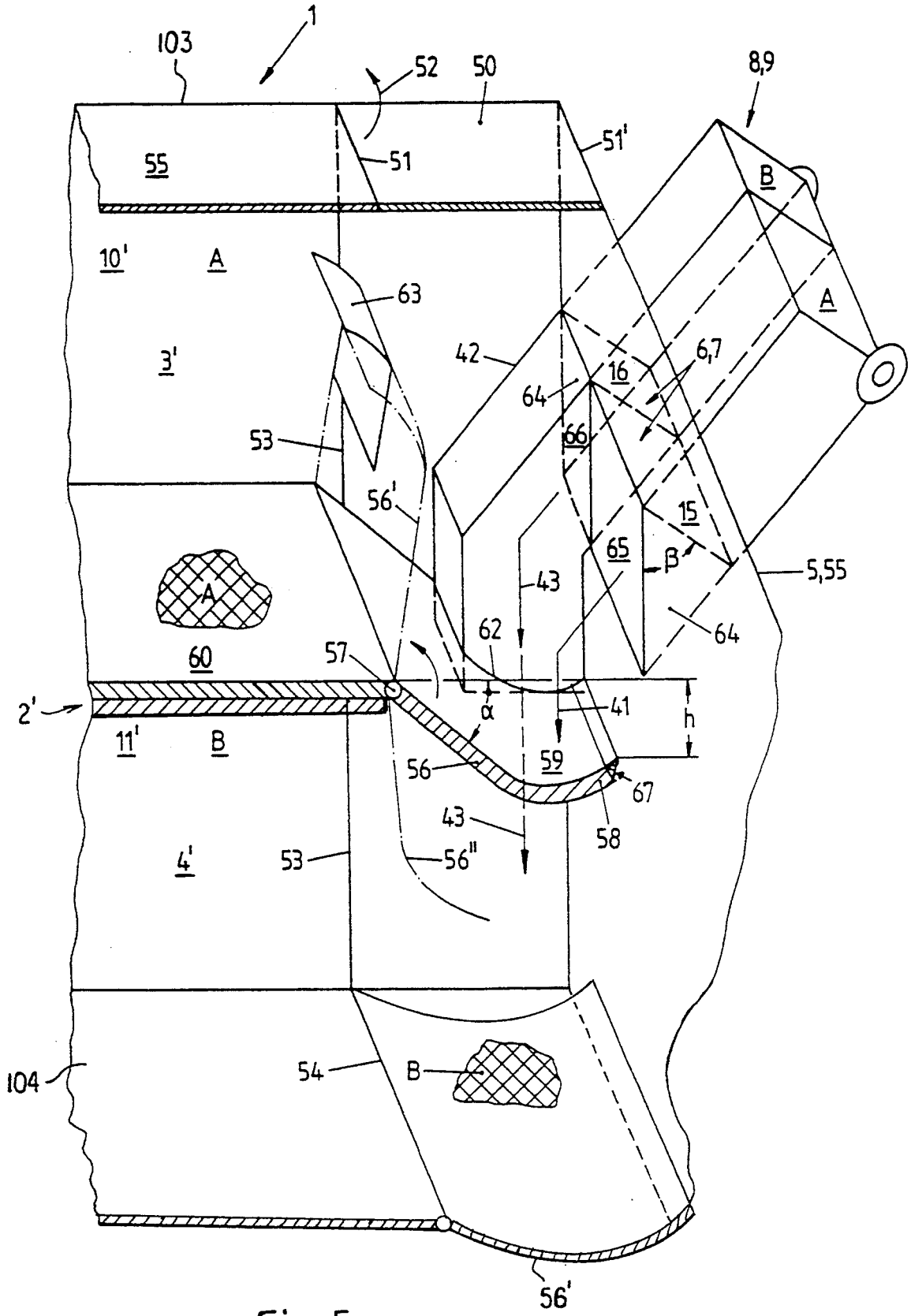
FIG. 5*c* is a three-dimensional inside view showing a modification of the arrangement shown in FIG. 5*b*.

FIG. 5*c* illustrates an embodiment that is similar to that shown in FIG. 5*b*. In FIG. 5*c*, individual containers 103 and 104 are combined to form the stowage compartments 3' and 4', and the bottom wall of container 103 rests on the top wall of container 104 to provide the partition 2' between the stowage compartments. In this embodiment the lower container 104 has its own swivelable stowage flap 56' in lieu of the lower loading region 61 in the embodiment of FIG. 5*b*.

The principles of the invention, as illustrated in FIGS. 1 to 5*c*, can of course also be applied to a garbage can 8, 9 having a partition 12 which is not disposed at right angles to the axis of rotation 46 of the lid 47 of the garbage can, but for example parallel thereto. In this case, the partition 14 of the charging openings 6, 7 would be offset by 90°.

A further development of the present invention provides for all the contents of a garbage can 8, 9, that is to say both the fraction A and the fraction B, to be able in special cases to be emptied entirely into one of the stowage compartments 3, 4 (see, for example, FIG. 1).

For the purpose of emptying the contents of a garbage can, or a fraction thereof, into the stowage compartment which is not normally the correct one, that is to say for example in order to empty the fraction A from the can 8 into the stowage compartment 4 appertaining to the fraction B, the partition 14 of the charging openings 6, 7 can, for example, be temporarily removed, turned round or moved away, so that the fractions A, B can be brought together and transferred to the chamber 4 by way of the intermediate container 17. At the same time the filling opening 15 of the charging opening 6 must remain closed, so that the fraction A will not pass into the chamber A. In order to deliver the fraction A from the garbage can 9 into the stowage compartment 4 for the fraction B, the partition 14 is likewise temporarily removed and access to the intermediate container 19 is blocked.

As an alternative, it is possible for the opening of the charging openings 6, 7 to be so designed that the entire contents, that is to say the fractions A and B in the garbage can, can be completely emptied into one of the filling openings 15, 16 and therefore into one of the stowage compartments of the vehicle. Each filling opening 15, 16 of the respective charging openings 6, 7 can then for example be matched to the entire opening of the garbage can 8, 9, so that the entire contents of the garbage can in each case can be emptied into a single filling opening 15, 16. A lateral displacement of the filling openings 15, 16 for matching to the desired garbage-can chamber is also possible.

In the embodiment of the invention provided with a bucket conveyor or wheel elevator 25 to 27 or with a guide plate 32, 33 (FIGS. 3, 3*a*, 3*b*), the previously explained basic principle can be put into practice by providing these devices with an additional ejection opening 49 which serves to empty the respective garbage fraction into the vehicle chamber not in itself intended for this fraction. This may, for example, be a flap 49 (FIG. 3*a*) or some other closable ejection opening 49 (FIG. 3, 3*a*, 3*b*). In order to form a through opening, the guide plate (32, 33) can, for example, also be temporarily removed by a translatory or swiveling movement.

The invention is not restricted to the examples described and illustrated. On the contrary, it also includes all further developments and modifications which are within the competence of the specialist and have no inventive content of their own.

I claim:

1. A garbage collection and transportation system, comprising:

a garbage can having a first chamber for a first type of garbage and a second chamber for a second type of garbage, the first and second chambers of the garbage can being separated by a garbage can partition; and a garbage truck having a first stowage chamber for the first type of garbage and a second stowage chamber for the second type of garbage, the first and second stowage chambers being separated by a garbage truck partition, the garbage truck additionally having a loading wall with a first portion which is exposed to the first stowage chamber and a second portion which is exposed to the second stowage chamber, the first portion of the loading wall having a charging opening with first and second portions which are separated by a charging opening partition, the first portion of the charging opening receiving garbage of the first type from the first chamber of the garbage can and the second portion of the charging opening receiving garbage of the second type from the second chamber of the garbage can when garbage is emptied from the garbage can into the garbage truck through the charging opening while the garbage can partition is aligned with the charging opening partition, the garbage truck additionally including transfer means for transferring garbage of the second type from the second portion of the charging opening through the garbage truck partition to the second stowage chamber.

2. A garbage truck for collecting garbage from a garbage can having a first chamber for a first type of garbage and a second chamber for a second type of garbage, the first and second chambers of the garbage can being separated by a garbage can partition, said garbage truck comprising:

means for providing a garbage stowage region having a first stowage chamber for the first type of garbage and a second stowage chamber for the second type of garbage, the means for providing a garbage stowage region including a garbage truck partition which separates the first and second stowage chambers;

a loading wall with a first portion which is exposed to the first stowage chamber and a second portion which is exposed to the second stowage chamber, the first portion of the loading wall having a charging opening with first and second portions, the first portion of the charging opening receiving garbage of the first type from the first chamber of the garbage can and the second portion of the charging opening receiving garbage of the second type from the second chamber of the garbage can when garbage is emptied from the garbage can into the garbage truck through the charging opening;

a charging opening partition which separates the first and second portions of the charging opening, the charging opening partition being positioned so that it is aligned with the garbage can partition while the garbage is being emptied through the charging opening; and transfer means for transferring garbage of the second type from the second portion of the charging opening through the garbage truck partition to the second stowage chamber.

3. The system of claim 2, wherein the transfer means comprises an intermediate container which receives garbage of the second type which has been emptied through the second portion of the charging opening, the intermediate container being movable between the first and second stowage compartments.

4. The system of claim 2, wherein the transfer means comprises an endless conveyor device.

5. The system of claim 4, wherein the endless conveyor device is a rotating bucket conveyor.

6. The system of claim 2, wherein the transfer means comprises a chute.

7. The system of claim 2, wherein the second portion of the loading wall has another .charging opening with first and second portions which are separated by another charging opening partition, the first portion of the another charging opening receiving garbage of the first type and the second portion of the another charging opening receiving garbage of the second type, wherein the charging opening and the another charging opening are disposed on opposite sides of the garbage truck partition, wherein the garbage truck partition and the charging opening partitions are vertical, and wherein the transfer means further includes means for transferring garbage of the first type from the first portion of the another charging opening through the garbage truck partition to the first stowage chamber.

8. The system of claim 7, wherein the transfer means comprises a plurality of intermediate containers which are mounted so that their positions can be exchanged in a rotary movement.

9. The system of claim 8, wherein the intermediate containers have garbage ejection openings, and wherein the transfer means further comprises means for selectively opening and closing the ejection openings.

10. The system of claim 7, wherein the transfer means comprises an endless conveyor device.

11. The system of claim 10, wherein the endless conveyor device is a rotating bucket conveyor.

12. The system of claim 2, wherein the garbage truck partition is horizontal and one of the stowage chambers is positioned above the other, and wherein the loading wall has another charging opening with first and second portions which are separated by another charging opening partition, the first portion of the another charging opening receiving garbage of the first type and the second portion of the another charging opening receiving garbage of the second type.

13. The system of claim 12, wherein the first stowage chamber is above the second stowage chamber, wherein the another charging opening is provided in the first portion of the loading wall, and wherein the transfer means further includes means for transferring garbage of the second type from the second portion of the another charging opening through the garbage truck partition to the second stowage chamber.

14. The system of claim 13, wherein the transfer means comprises chutes connecting the second portions of the charging opening and the another charging opening to the second stowage chamber.

15. The system of claim 14, wherein the garbage truck partition includes a fixed portion and a movable portion, the movable portion of the garbage truck partition including a stowage flap which is pivotal about a horizontal axis, the stowage flap having apertures for passage of the chutes.

16. The system of claim 15, wherein the stowage flap is generally trough-shaped and is held at a receiving position while garbage is being emptied into the garbage truck, the stowage trough being inclined downwardly from the horizontal axis when the stowage flap is in the receiving position.

17. The system of claim 2, wherein the garbage truck partition lies in a plane, and wherein one of the portions of the charging opening has a side which lies in the plane of the garbage truck partition.

18. The system of claim 2, wherein the charging opening partition is removably mounted on the garbage truck, and wherein the garbage truck further comprises means for blocking communication between the first portion of the charging opening and the first stowage chamber when the charging opening partition is removed.

19. The system of claim 18, wherein at least one of the portions of the charging opening is laterally displaceable and can be adapted to each chamber of the garbage can.

20. The system of claim 18, wherein the transfer means comprises a movably mounted container having a garbage ejection opening, and a guide plate which engages the container to selectively open and close the ejection opening, the guide plate being movable out of engagement with the container.

21. The garbage truck of claim 2, wherein the means for providing a garbage stowage region comprises individual containers which form the first and second stowage chambers.

* * * * *